United States Patent [19]

Cassells

[11] Patent Number: 4,624,482

[45] Date of Patent: Nov. 25, 1986

[54] ELONGATED SHEET OF MATERIAL

[76] Inventor: Wayne R. Cassells, 6S530 Dunlap Rd., Naperville, Ill. 60540

[21] Appl. No.: 630,876

[22] Filed: Jul. 13, 1984

[51] Int. Cl.[4] ..... B42D 15/00

[52] U.S. Cl. ..... 283/62; 281/5; 283/71

[58] Field of Search ..... 281/1, 2, 5; 282/1 R, 282/2; 283/66, 81, 105, 71

[56] References Cited

U.S. PATENT DOCUMENTS

| | | | |
|---|---|---|---|
| 386,618 | 7/1884 | Wheeler | 281/5 X |
| 405,412 | 6/1889 | Hicks | 281/5 X |
| 453,003 | 5/1891 | Hicks | 283/105 X |
| 1,760,417 | 5/1930 | Lake | 283/66 R X |
| 1,843,771 | 2/1932 | Kline | 281/5 X |
| 2,620,205 | 12/1952 | Vogt | 281/5 |
| 4,210,688 | 7/1980 | Sato | 283/81 X |
| 4,335,172 | 6/1982 | Sato | 283/81 X |
| 4,477,103 | 10/1984 | Bertolazzi | 281/5 X |

*Primary Examiner*—Paul A. Bell
*Attorney, Agent, or Firm*—Robert V. Jambor

[57] ABSTRACT

An elongated sheet of printed material for a roll stamp dispenser having formed flaps serving as driving sprockets and also having perforated score lines for tearing the stamp from the dispenser. A plurality of partially cut spaced apart flap groups formed of flaps along transverse lines mate with driving pins on the roll stamp dispenser. The flaps remain in tact with the stamp roll so as not to destroy the printed appearance of the stamp roll. Perforated transverse continuous score lines are formed at predetermined positions along the longitudinal length of the roll for use in separating adjacent sections of the roll as desired.

11 Claims, 6 Drawing Figures

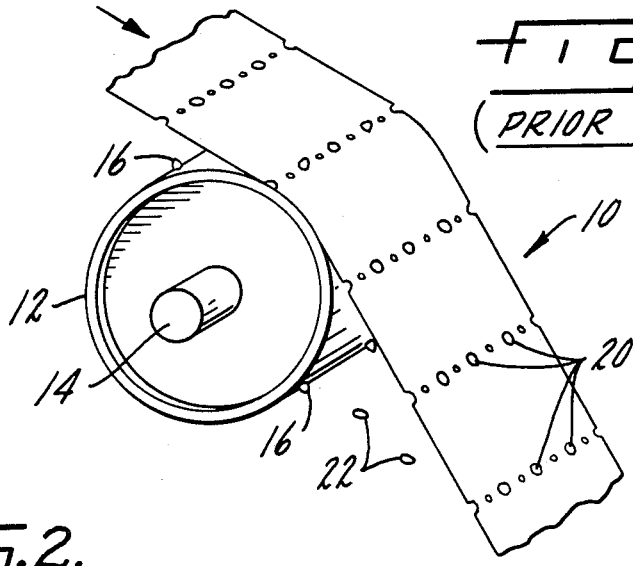
Fig. 1.
(PRIOR ART)
Fig. 2.
(PRIOR ART)
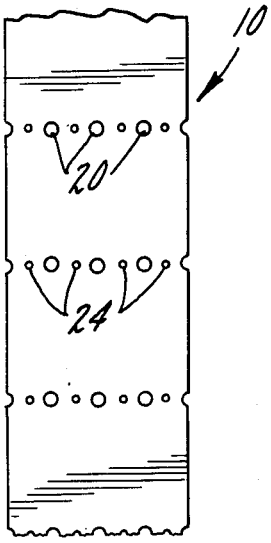
Fig. 3.
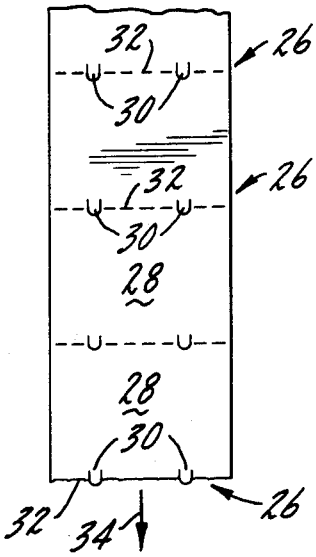
Fig. 4.
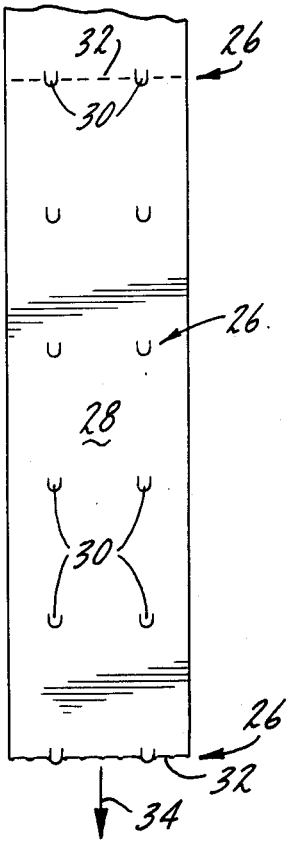
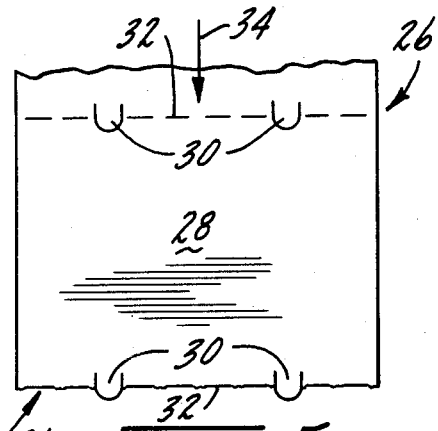
Fig. 5.
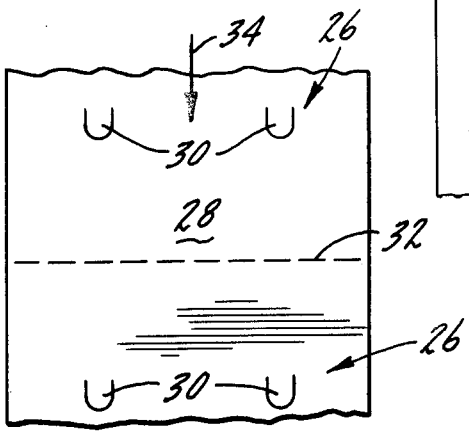
Fig. 6.

ELONGATED SHEET OF MATERIAL

BACKGROUND OF THE INVENTION

This invention relates generally to an elongated sheet of printed material and more particularly to a printed stamp roll for use in a stamp dispense with the driving sprockets formed in the roll remaining in tact with the roll so as not to destroy the printed appearance of the stamp.

It is known in the merchandising of products such as beverages to give trading stamps at the various stores in connection with purchases made by the customers. The stamps are dispensed from a machine in the vicinity of the checker. The machine contains a driving roll having spaced pins for driving the stamps through the machine. The spaced pins engage holes in the stamps and pull the stamps forward whenever the checker activates the dispenser.

Conventional stamps used are manufactured in various ways and generally have holes formed in the stamps which are punched out on the conventional stamps during manufacture. Many of the punched out holes contain discs which remain with the stamp and tend to clog the stamp dispenser since the discs are punched out in the dispenser as the stamp passes over the driving pins. The buildup of punched out discs generally makes a mess in the area of the checker similar to miniature confetti which is difficult to sweep up and destroys the appearance of the checkout counter.

In addition the punched out holes on a conventional stamp sometimes takes out a very important portion of the imprinted message such as the expiration date and generally destroys the overall appearance of the printed stamp.

It is known in the art of dispensing elongated sheets of material to provide a series of cutout holes and elongated slits which are used in combination to sever the sheet at the desired position. An example of this is shown in the U.S. Pat. No. 386,618, issued July 24, 1888 to S. Wheeler. It is also known to provide a series of cutout tabs singly without the use of perforated cuts for the purpose of tearing the sheet at a given line as taught in the U.S. Pat. No. 404,412, issue June 18, 1889 to O. H. Hicks.

It is also known in the manufacture of detachable record cards to provide for a series of tabs formed with discontinuous cuts for the combined purpose of severing the record card at an appropriate place as shown in the U.S. Pat. No. 1,760,417, issued May 27, 1930 to C. D. Lake. It is also known to use a series of continuous cuts without tabs or holes for severing elongated sheets of material as taught in the U.S. Pat. No. 453,003, issued May 26, 1891 to O. H. Hicks.

The before described prior art continuous sheets with their various severing methods are undoubtedly sufficient for the purpose intended but do not teach the new and novel features of the applicant's invention as will be described hereinafter.

SUMMARY OF THE INVENTION

The present invention is designed for an elongated sheet of printed material for use in a dispenser such as a roll stamp dispenser of the type before described which has driving pins for engagement with sprockets formed in the stamp roll. The elongated sheet or roll stamp is formed with a plurality of partially cut, spaced apart flap groups formed in a predetermined transverse position and in a predetermined spacing along the length of the elongated sheet or stamp roll. The partially cut, spaced apart flap groups are formed from a plurality of flaps which remain with the sheet thereby leaving the printed material in tact on the sheet with the flap serving a sprocket for use in driving the sheet through the roll dispenser by the driving pins on the dispenser. The novel elongated sheet or stamp roll also contains a series of perforated score lines formed at predetermined positions transversely along the elongated sheet with the perforated score line allowing the sheet to be separated as desired along the score line. The score line may be formed along the same transverse line as the flap groups and may also be formed on different transverse score lines within the spirit and scope of the invention. In a modification of the preferred embodiment the score lines may be formed along a portion of the flap groups as desired to provide a longer stamp which may have more printed material contained on the stamp.

DESCRIPTION OF THE DRAWINGS

FIG. 1 is a perspective view of a typical roll stamp dispenser showing prior art stamp roll being driven by a dispenser.

FIG. 2 is a plan view of a typical prior art stamp roll showing a plurality of sprocket holes and perforations formed in the stamp roll.

FIG. 3 is a plan view of the applicant's new and novel stamp roll showing the plurality of partially cut, spaced apart flap groups formed along the same transverse line as a series of perforated score lines used for severing individual stamps from the roll.

FIG. 4 is a plan view of a modification of the preferred embodiment showing the transverse score lines being formed on a portion of the flap groups to provide a longer tearable stamp for use in a stamp dispenser.

FIG. 5 is a plan view of a single stamp showing in greater detail the construction of the flap groups forming the sprocket used to drive the stamp through the stamp dispenser and also showing how the flap remains in tact on the roll without destroying any printed material contained on that portion of the stamp.

FIG. 6 is a modification of the preferred embodiment showing the perforated score line formed on a different transverse line than the plurality of flap groups of the type hereinbefore described.

DETAILED DESCRIPTION

Turning now to the drawing, there is illustrated in FIG. 1 a prior art perspective of a typical roll stamp dispenser for dispensing a stamp roll of printed material shown generally by the numeral 10. The roll stamp dispenser 12 is rotatable on a shaft 14 carried by a frame not shown in the drawing and activated by various means known in the art for rotating driving rolls. A plurality of driving pins 16 are positioned on the dispenser 12 and are designed to mate with sprockets or holes 20 formed in the stamp. Due to the particular construction of the sprocket holes 20 formed by the cutting dies, a disc 22 will remain with the stamp held loosely by the stamp until the stamp passes over the driving pins 16. As the stamp 10 passes over the driving pins 16 a large amount of loose punched out discs 22 will separate from the stamp and clog in the dispenser and also around the area of the dispenser making a mess. The loose discs 22 are similar to miniature confetti causing problems in the dispenser should they not be periodically cleaned out.

Referring now to FIG. 2 of the drawing there is shown a plan view of a prior art roll stamp of the type used in the FIG. 1 illustration which is formed with a plurality of sprocket holes 20 in combination with a plurality of single perforations 24 used for tearing the stamp from the dispenser at the appropriate place.

Referring to FIG. 3 of the drawing there is shown the applicant's new and novel stamp roll which utilizes a plurality of partially cut, spaced apart flap groups shown generally by the numeral 26 which are formed in a predetermined transverse position on the stamp roll 28. The flap groups 26 are formed from a series of generally U-shaped flaps 30 formed in the positions shown to mate with the appropriate driving pins 16 of the dispenser 12 that may be used. In the embodiment shown, the U-shaped configuration results in a partially cut, spaced apart flap which remains with the sheet and does not clog up the stamp dispenser as was common with the prior art loose discs 22. The flaps 30 are formed in the direction shown whenever the stamp roll 28 is traveling in the direction shown by the arrow 34 since the sprockets formed by the leading edge of the flaps are engaged by the driving pins 16.

When formed in this manner, the applicant's novel stamp roll 28 contains an unbroken surface throughout the length of the stamp which does not destroy the printed appearance of the advertising material on the stamp.

A series of perforated score lines 32 are formed at predetermined positions transversely along the stamp 28 with the perforated score lines allowing the stamp to be separated at the desired point along the particular score line.

Referring now to FIG. 4 of the drawing there is shown a plan view of a modification of the applicant's invention wherein there are formed the plurality of partially cut, spaced flap groups 26 formed with a series of perforated score lines 32 formed along the transverse line of a portion of the flap groups. It can be seen in FIG. 4 then how the dispensed stamp would be formed of five individual stamps since there are six flap groups 26 forming the longer dispensed stamp. In the FIG. 4 modification, the flap groups 26 would be formed of individually shaped flaps 30 formed in the direction shown for use whenever the stamps 28 were driven in the direction shown by the arrow 34.

Referring now to FIG. 5 of the drawing there is shown a plan view of an individual stamp showing in greater detail the construction of the flaps 30 and also showing how the flaps remain in tact with the stamp 28 whenever the stamp is driven by the driving pins 16.

FIG. 6 shows a modification of the preferred embodiment wherein the perforated score lines 32 are formed on a different transverse line than the transverse lines of the flap groups 26 of the applicant's invention. Other variations are possible within the spirit and scope of the invention and the perforated score lines 32 may be formed on at least an alternating transverse line of each group of partially cut flap groups 26. In addition the perforated score lines 32 may be formed on the same transverse line as each group of partially cut flaps 26. Other variations are within the spirit and scope of the invention in the construction of the individual flaps 30 which may be formed in other configurations all of which would remain in tact with the roll 28 as the roll passes over the driving pins 16.

From the foregoing, it will be apparent to those skilled in the art that various additions, substitutions, modifications and omissions may be made to the construction of the present invention without departing from the spirit and scope of the invention. Thus, it is intended that the present invention cover the additions, substitutions, modifications and omissions of this invention which come within the permissible scope of the appended claims.

I claim:

1. An elongated printed stamp sheet for use in a dispenser having driving pins for engagement with sprockets in the elongated sheet, comprising a single layer having a plurality of partially cut spaced apart flap groups formed in a predetermined spacing along the length of the elongated sheet, the sheet further comprising a series of perforated score lines formed at predetermined positions transversely along the elongated sheet, the perforated score lines and flap groups being formed on the single layer of the sheet, the partially cut, spaced apart flat groups remaining with the sheet thereby leaving the printed material intact on the sheet while serving as sprockets for driving the sheet with the driving pins, the perforated score lines allowing the sheet to be separated as desired along the score lines.

2. The elongated printed stamp sheet as defined in claim 1 wherein each of the perforated score lines are formed at the same transverse position as a group of partially cut flaps.

3. The elongated printed stamp sheet as defined in claim 2 wherein a perforated score line is formed at the same transverse position as each group of partially cut flaps.

4. The elongated printed stamp sheet as defined in claim 2 wherein the perforated score lines are formed at every sixth group of partially cut flaps.

5. The elongated printed stamp sheet as defined in claim 1 wherein each partially cut flap is formed in a generally U-shaped configuration and defines a leading edge adapted to be engaged by the driving pins.

6. The elongated printed stamp sheet as defined in claim 1 wherein the perforated score lines are formed on at different transverse positions than the transverse positions of each group of partially cut flaps.

7. A printed stamp roll for a stamp dispenser having a plurality of driving pins, spaced apart a predetermined distance comprising:

(a) a plurality of partially cut, spaced apart flap groups formed along predetermined transverse lines, the flap groups being spaced apart the same predetermined distance as the distance between sets of driving pins and defining sprockets for driving said roll with the driving pins and being constructed so that they remain intact with the stamp roll so as not to destroy the printed appearance of the stamp roll; and (b) a plurality of spaced apart transverse perforated continuous score lines formed at predetermined positions along the longitudinal length of the roll, the score lines being used to separate adjacent sections of the roll as desired;

(c) the stamp roll having a single layer, with both the flap groups and the score lines formed on the single layer.

8. The stamp roll as defined in claim 7 wherein each of the score lines are formed along the same transverse position as a flap group and wherein each partially cut flap is formed in a generally U-shaped configuration and defines a leading edge adapted to be engaged by the driving pins.

9. The stamp roll as defined in claim 7 wherein the flap groups and the score lines are formed along different transverse lines.

10. The stamp roll as defined in claim 8 wherein each transverse position of flap groups includes a score line.

11. The stamp roll as defined in claim 7 wherein every sixth flap group includes a score line formed therealong.

* * * * *